US006339920B1

(12) United States Patent
Yokoyama

(10) Patent No.: US 6,339,920 B1
(45) Date of Patent: Jan. 22, 2002

(54) ROTATION-RESISTING WIRE ROPE

(75) Inventor: Yasuo Yokoyama, Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/639,932

(22) Filed: Aug. 17, 2000

(30) Foreign Application Priority Data

Aug. 27, 1999 (JP) ..... 11-241663

(51) Int. Cl.[7] ..... D02G 3/02

(52) U.S. Cl. ..... 57/210; 57/211; 57/212; 57/213; 57/214; 57/218

(58) Field of Search ..... 57/210, 211, 212, 57/213, 214, 218

(56) References Cited

U.S. PATENT DOCUMENTS 4,365,467 A * 12/1982 Pellow ..... 57/214
4,470,249 A * 9/1984 Chiappetta et al. ..... 57/213
4,827,708 A * 5/1989 Verreet ..... 57/212
6,260,343 B1 * 7/2001 Pourladian ..... 57/200

FOREIGN PATENT DOCUMENTS

JP 8-92885 A 9/1994

* cited by examiner

*Primary Examiner*—John J. Calvert
*Assistant Examiner*—Shaun R Hurley
(74) *Attorney, Agent, or Firm*—Oliff & Berridge, PLC

(57) ABSTRACT

A wire rope for a heavy-load crane, such as a ladle crane is provided that is not only almost rotation-resistant but is also unlikely to be broken by wear and fatigue of wires. The rotation-resisting wire rope has a plurality of side strands. In side each strand, wires are laid in the same direction as the lay of core strand wires, around the periphery of a core strand. The side strands are laid in a direction opposite to the lay of the core strand wires so as to form the wire rope. The side strands preferably have a smaller pitch multiple than a pitch multiple of the wire rope. The ratio between a diameter of the side strands and a diameter of the core strand is preferably about 1.3 to about 1.8. The pitch multiple of strands is preferably about 5 to about 8 and the pitch multiple of the wire rope is preferably about 8 to about 10. Both the core strand and the side strands preferably have shaped wires, having a flattened surface, at an outermost ply.

6 Claims, 5 Drawing Sheets

CONDITIONS

ROPE DIAMETER : 35.5mm
ROPE TYPE : IWSC8 X Fi(29)
LAID DIRECTION OF ROPE : Z
LAID DIRECTION OF CORE STEEL : S

FIG.5

| No. | Classification | Core strand (Pitch multiple of 6) | | | Side strand (Pitch multiple of 6) | | | Construction of wire rope | | | Test result |
|---|---|---|---|---|---|---|---|---|---|---|---|
| | | Direction of lay | Outer diameter d1 | Shape | Direction of lay | Outer diameter d2 | Shape | Direction of lay | d1/d2 | Pitch multiple | Ratio of repeated bendings until breakage |
| 1 | Embodiment | S | 15.1 | Shaped | S | 10.7 | Shaped | S-S-Z | 1.4 | 8 | 150.0% |
| 2 | Embodiment | S | 15.1 | Shaped | S | 10.7 | Shaped | S-S-Z | 1.4 | 9 | 151.0% |
| 3 | Embodiment | S | 15.1 | Shaped | S | 10.7 | Shaped | S-S-Z | 1.4 | 10 | 150.0% |
| 4 | Embodiment | S | 17.2 | Shaped | S | 9.7 | Shaped | S-S-Z | 1.8 | 8 | 195.0% |
| 5 | Embodiment | S | 17.2 | Shaped | S | 9.7 | Shaped | S-S-Z | 1.8 | 9 | 196.0% |
| 6 | Embodiment | S | 17.2 | Shaped | S | 9.7 | Shaped | S-S-Z | 1.8 | 10 | 195.0% |
| 7 | Com. embodiment | S | 11.8 | Shaped | S | 11.8 | Round | S-S-Z | 1.0 | 7 | 61.8% |
| 8 | Com. embodiment | S | 15.1 | Shaped | S | 10.7 | Round | S-S-Z | 1.4 | 7 | 110.0% |
| 9 | Com. embodiment | S | 17.2 | Shaped | S | 9.7 | Round | S-S-Z | 1.8 | 7 | 143.0% |
| 10 | Com. embodiment | S | 18.6 | Shaped | S | 8.4 | Round | S-S-Z | 2.2 | 7 | 118.0% |
| 11 | Com. embodiment | S | 11.8 | Round | S | 11.8 | Round | S-S-Z | 1.0 | 7 | 56.2% |
| 12 | Com. embodiment | S | 15.1 | Round | S | 10.7 | Round | S-S-Z | 1.4 | 7 | 100.0% |
| 13 | Com. embodiment | S | 17.2 | Round | S | 9.7 | Round | S-S-Z | 1.8 | 7 | 130.0% |
| 14 | Com. embodiment | S | 18.6 | Round | S | 8.4 | Round | S-S-Z | 2.2 | 7 | 107.0% |

ROTATION-RESISTING WIRE ROPE

BACKGROUND OF THE INVENTION

1. Field of the Invention

The present invention relates to a rotation-resisting wire rope, and particularly relates to a long rotation-resisting wire rope for use in overhead cranes and the like.

2. Description of the Related Art

There are various types of construction for wire ropes (mentioned as ropes hereinafter), and the ropes are used based on standards such as Japanese Industrial Standards (JIS). Among them, the ropes under JIS No. 13 or JIS No. 18 are generally used for cranes, and are rotating wire ropes. The rotating property is a characteristic of wire rope to rotate by itself when tension is added to the wire rope. For ladle cranes at steelmaking yard, a long wire rope is run over a plurality of sheaves and sustains a heavy load. In using a rotating wire rope for such a crane, the wire rope often rotates between sheaves (pulleys) while the rope is being repeatedly run over the sheaves. The rope is repeatedly alternately bent in mutually opposite directions while being run over a plurality of sheaves, thus shortening the lifespan of the rope by fatigue, which has been considered a problem.

In order to solve this problem, there has been an attempt to use so-called non-rotating wire ropes or rotation-resisting wire ropes. The rotation-resisting property means that the rotating force of a wire rope is small when tension is added to the wire rope.

In Japanese Unexamined Patent Application Publication No. 8-92885, a rotation-resisting wire rope is proposed that has a multi-ply laid core strand having shaped wires with a flattened surface at least at an outermost ply and a plurality of core strands provided around the periphery of the core strand and laid in the same direction as the lay of the core strand. Side strands are laid in the direction opposite to the lay of the core strand so as to form a wire rope, and a pitch multiple of the rope is larger than that of the side strands.

This proposal can somewhat solve the conventional problem wherein bending directions are reversed as a wire rope is run over sheaves and the wire rope repeatedly alternately receives bending stress in mutually opposite directions while being run over a plurality of sheaves, which shortens the lifespan of the wire rope by fatigue. However, the rotation-resisting property of the above-noted technique is insignificant. There are also some remaining problems, including breakage due to contact of external wires of a wire rope against sheaves and a decrease in lifespan due to breakage by contact between core strands and side strands.

SUMMARY OF THE INVENTION

An object of the present invention is to solve the above-noted problems of conventional rotation-resisting wire ropes. More specifically, it is an object of the present invention to provide a long wire rope for, for example, overhead cranes that is practically non-rotating but is unlikely to be broken by wear and fatigue.

In order to solve the above-noted problems, the present inventors conceived and tested various constructions of wire ropes and invented the present invention.

Specifically, a rotation-resisting wire rope of the present invention has a plurality of side strands, each side strand having wires that are laid in the same direction as the lay of core strand wires, around the periphery of a core strand. The side strands are laid in the direction opposite to the lay of the core strand wires so as to form a wire rope. A pitch multiple of the wires of the side strands is preferably smaller than a pitch multiple of the wire rope. Ratios between a diameter of the side strands and a diameter of the core strand are preferably about 1.3 to about 1.8. The pitch multiple of the wires of the side strands is preferably about 5 to about 8, and the pitch multiple of the wire rope is preferably about 8 to about 10. Both the core strand and the side strands preferably have shaped wires with a flattened surface at an outermost ply.

BRIEF DESCRIPTION OF THE DRAWINGS

Embodiments of the invention will now be described by way of non-limitative example with reference to the accompanying drawings in which:

FIG. 5 is a table showing lifespans of wire ropes of this invention and comparative embodiments.

DESCRIPTION OF THE PREFERRED EMBODIMENTS

Figure 1A:
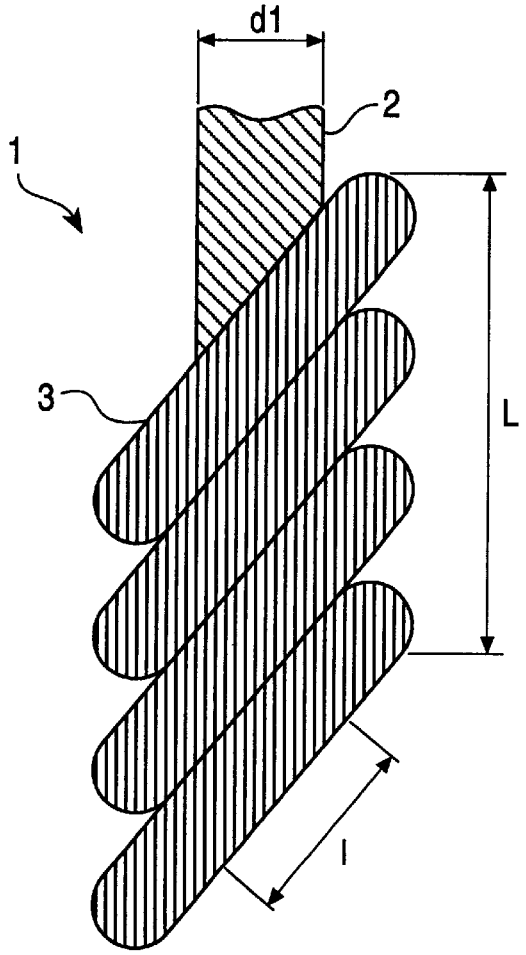
FIG. 1A is a front view showing a construction of a wire rope relating to the present invention.
Figure 1B:
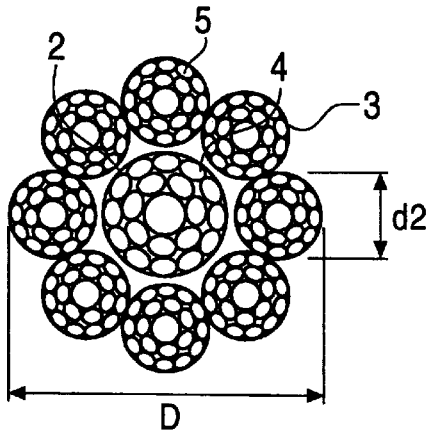
FIG. 1B is a cross-sectional view of the wire rope shown in FIG. 1A.

FIGS. 1A and 1B show a basic construction of a rotation-resisting wire rope 1 relating to the present invention. The non-rotating wire rope 1 relating to the present invention has a plurality of side strands 3, in which wires 5 are laid (S-lay) in the same direction as the lay (S-lay) of core strand wires 4, around the periphery of a core strand 2. The side strands 3 are laid in the direction opposite to the lay of the core strand wires 4 (Z-lay), thus forming a wire rope. The combined directions of lay are abbreviated as S-S-Z hereinafter. By combining the directions of lay, a rotation-resisting is added to the wire rope 1.

A strand pitch multiple is the ratio (1/d2) of a pitch length (l) of side strands relative to an outer diameter (d2) of side strands. A rope pitch multiple is the ratio (L/D) of a rope pitch length (L) relative to an outer diameter (D) of a rope.

The present inventors experimented with suitable combinations of pitch multiples of wire ropes and pitch multiples of strands so as to provide a rotation-resisting property. Rotating torque is used as a parameter for the rotation-resisting property of a wire rope. Rotating torque is the torque generated on a wire rope as an axis when tension is added to the wire rope under constant conditions. Smaller rotating torque indicates a better rotation-resisting property of a wire rope. In the present invention, a rotating torque of less than $1\times10^{-3}$kgm indicates a rotation-resisting property.

Figure 2:
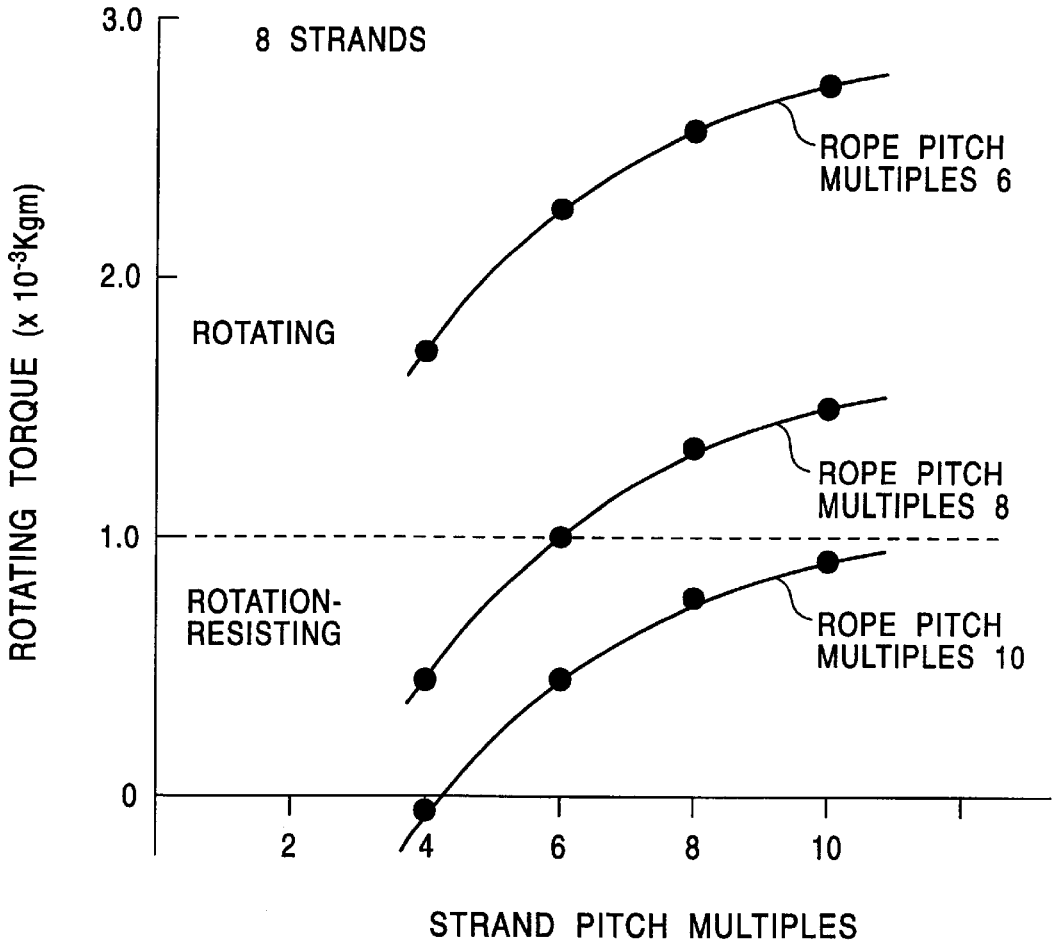
FIG. 2 shows experimental results of the effect of strand pitch multiples on rotating torque (number of strands: 8, outer diameter of rope D: 35.5 mm, S-S-Z lay)

The experimental results are shown below. FIG. 2 shows the effect of strand pitch multiples on rotating torque for a wire rope of an S-S-Z lay, having 8 strands and a wire rope outer diameter D of 35.5 mm. The results show each case of rope pitch multiples of 6, 8 and 10.

As shown in FIG. 2, when rope pitch multiples increase and strand pitch multiples decline, rotating torque decreases, thus providing a rotation-resisting property.

It is also found that a rope is nearly non-rotating at the rope pitch multiples of 8 to 10 and strand pitch multiples of less than 8.

Figure 3:
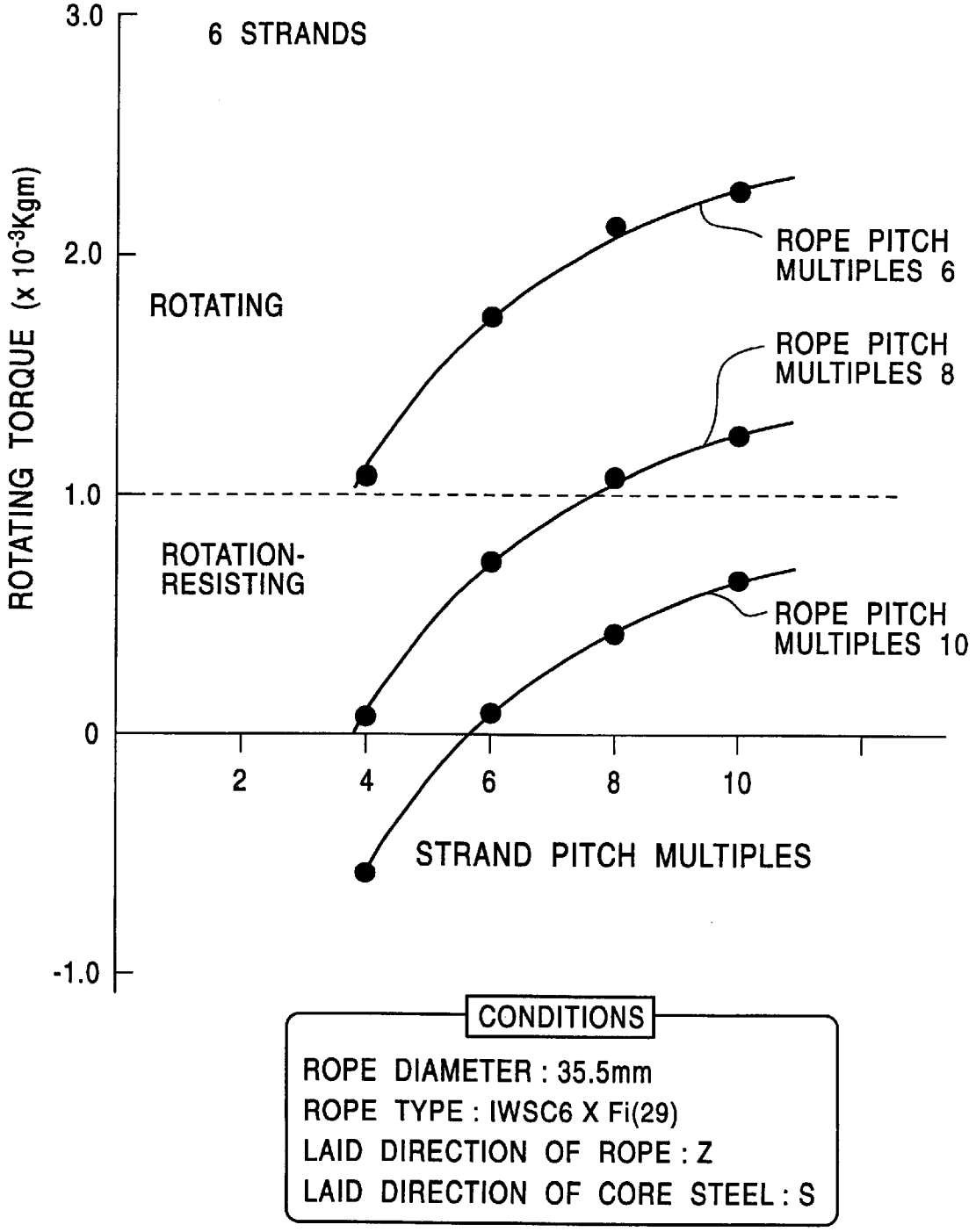
FIG. 3 shows experimental results of the effect of strand pitch multiples on rotating torque (number of strands: 6, outer diameter of rope D: 35.5 mm, S-S-Z lay)

FIG. 3 shows the effect of strand pitch multiples on rotating torque for a wire rope of an S-S-Z lay having 6 strands and a wire rope outer diameter D of 35.5 mm. The results show each case of rope pitch multiples of 6, 8 and 10.

As shown in FIG. 3, when rope pitch multiples increase and strand pitch multiples decline, rotating torque decreases, thus providing a rotation-resisting property.

It is also found that a rope is nearly non-rotating at rope pitch multiples of 8 to 10 and strand pitch multiples of less than 8.

The following conclusions are made from the experimental results shown in FIG. 2 and FIG. 3.

(1) Pitch multiples of a wire rope have much more effect on rotating torque than pitch multiples of side strands.

(2) Although pitch multiples of wire ropes are larger than pitch multiples of strands in conventional arts, the ordinary wire rope pitch multiple of around 7.5 cannot provide the sufficient level of a rotation-resisting property.

(3) Therefore, in the present invention, the pitch multiple of a wire rope is preferably about 8 to about 10, which is larger than the ordinary level of 7.5 in conventional arts.

(4) Furthermore, in order to provide a sufficient rotation-resisting property under this condition, strand pitch multiples are preferably about 5 to about 8.

Figure 4:
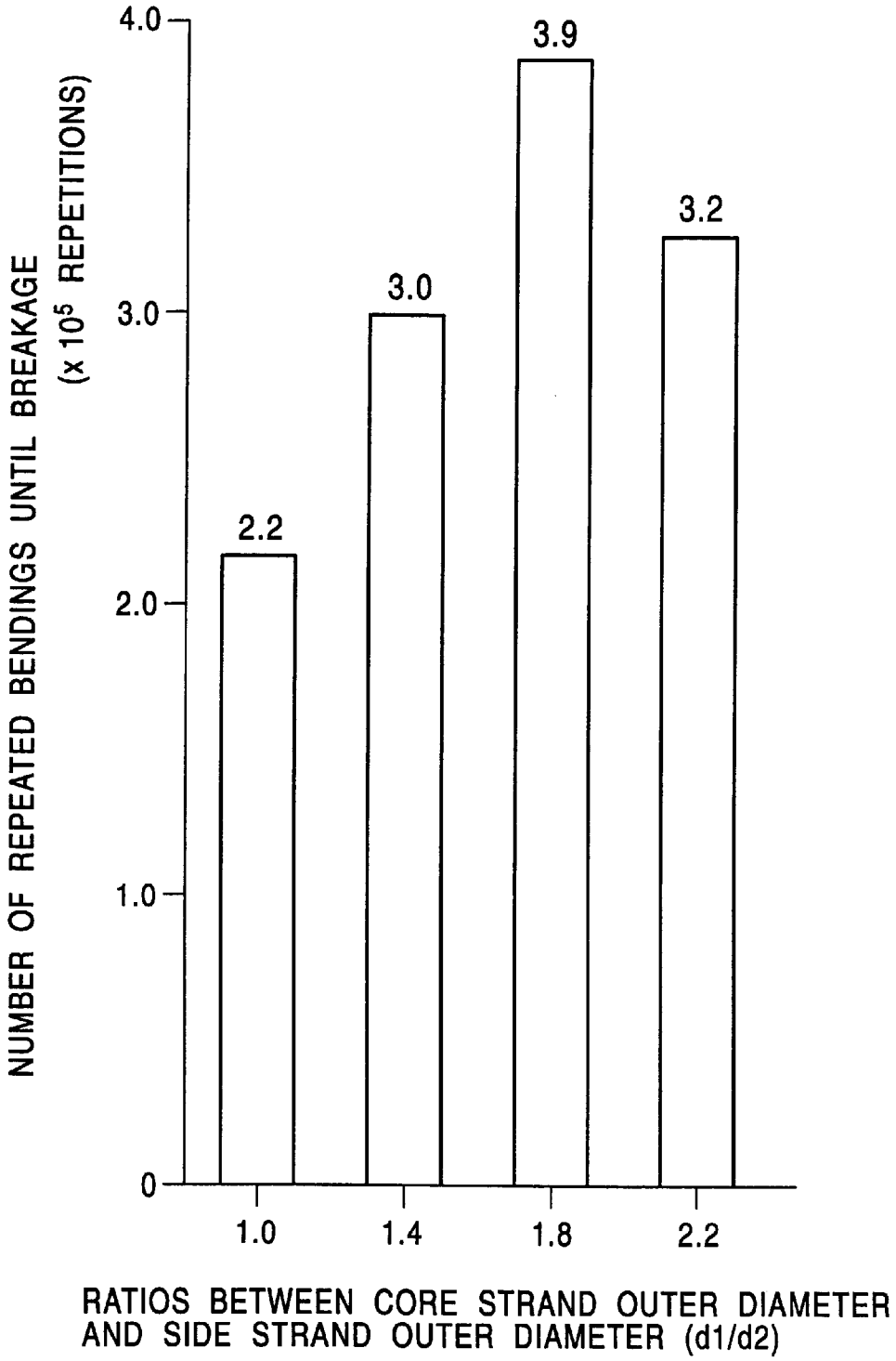
FIG. 4 shows experimental results of the effect of ratios between core strand outer diameter and side strand outer diameter on the number of repeated bendings until breakage.

In the present invention, optimum values are determined by the ratio (expressed as d1/d2 hereinafter) between an outer diameter (d1) of a core strand and an outer diameter (d2 ) of side strands. Optimum d1/d2 is determined because it provides significant effects on the number of repeated bendings until breakage, which is an indicator of the lifespan of a wire rope. Additionally, a d1/d2 ratio of 1.0 indicates that the outer diameters of a core strand and side strands are identical, and that six side strands are wound around the core strand. FIG. 4 shows the experimental results of the effect of d1/d2 on the number of repeated bendings until breakage. As d1/d2 increases, the number of repeated bendings until breakage increases and the lifespan of a wire rope is extended. However, as d1/d2 exceeds 1.8, the number of repeated bendings until breakage decreases, shortening the lifespan of a wire rope. The reasons thereof may be explained below. The increase in d1/d2 indicates that the number of side strands increases. As a contact surface to sheaves and a drum increases, wear is reduced. However, when there are too many side strands, wires become thinner and thus are easily breakable. The results show that the maximum lifespan of a wire rope is seen at d1/d2 of 1.8. When d1/d2 is 1.8, there are eight side strands. For practical use, the optimum level of d1/d2 is preferably about 1.3 to about 1.8.

Based on the experimental results mentioned above, optimum ranges of strand pitch multiples, rope pitch multiples and d1/d2 are determined, so that the rotating property of a wire rope is almost completely diminished and the breakage of wires due to bending fatigue can be prevented even if a wire rope is repeatedly run over a plurality of sheaves of a ladle crane or the like.

However, in the case of heavy-load cranes, such as ladle cranes, wires are broken not only by bending fatigue but also by contact fatigue among the wires. Moreover, breakage by contact stress at the grooves of sheaves should be considered for side strands.

Thus, both the core strand and the side strands have shaped wires with a flattened surface at an outermost ply in the present invention. As a result, it is found that contact surfaces among the wires can become much larger than the conventional contact surfaces, and so-called fretting may be reduced. The surface of the strands may be flattened by passing the strands, made of ordinary round core wires, through a drawing die.

Below, the lifespan of wire ropes of S-S-Z lay having an outer diameter of 35.5 mm are used as wire ropes at a steelmaking yard and the ropes have a side strand pitch multiple of 5, a rope pitch multiple of 9.5 and a ratio between a side strand diameter and a core strand diameter of 1.4 is compared. The lifespan of wire rope having a round core and round side strands is considered as 1.0. As seen in Table 1 the lifespan of wire ropes before the breakage of wires extends sharply (shaped) as the peripheral surface of side strands are flattened.

TABLE 1

| Core strand | Side strand | Lifespan ratio |
|---|---|---|
| Round | Round | 1.0 |
| Round | Shaped | 1.5 |
| Shaped | Round | 1.0 |
| Shaped | Shaped | 2.0 |

FIG. 5 shows the lifespan of wire ropes of the present invention and comparative embodiments. The wire ropes of fourteen different constructions in FIG. 5 were prepared and used for a ladle crane at a steelmaking yard. No. 1 to No. 6 are wire ropes of the present invention, and No. 7 to No. 14 are wire ropes of the comparative embodiments. The lifespan of a wire rope is evaluated from the cumulative number of repeated bendings until breakage, which is assumed based on working period at the time of disposal of a wire rope. In other words, the wire rope never actually completely breaks, since it is replaced when it becomes worn to a certain degree. Therefore, the lifespan is calculated just up to the point when the wire rope is replaced. Working conditions of the wire ropes are a lift distance of 38 m, a sheave diameter of 925 mm, a number of wire ropes used to hold a load being 44, and a load of 455 tons (t). Higher numbers of repeated bendings until breakage indicate longer lifespan of wire ropes, which longer and is preferable.

An average conventional technical level is Comparative Embodiment No. 12 in FIG. 5. The number of repeated bendings until breakage was 200,411 in Comparative Embodiment No. 12. The results of other embodiments are shown as percentages of to this number. The lifespans of Embodiments No. 1 to No. 6 were all longer than the lifespan of the comparative embodiments. Especially when d1/d2 was 1.8, the performance was at the best. For instance, in Embodiment No. 5, the number of repeated bendings until breakage was 392,864, and the lifespan was 196%, which is extremely long in comparison to the number of repeated bendings until breakage of 200,441 in Comparative Embodiment No. 12.

The present invention can provide a non-rotating wire rope with less possibility of breakage of wires due to fatigue, and can significantly extend the life of wires even if the wire rope is used for a heavy-load crane such as a ladle crane at a steelmaking yard and is bent repeatedly in use.

While the invention has been described in conjunction with the specific embodiments described above, many equivalent alternatives, modifications and variations will become apparent to those skilled in the art once provided with this disclosure. Accordingly, the exemplary embodiments of the inventions set forth above are considered to be illustrative and not limiting. Various changes to the described embodiments may be made without departing from the spirit and scope of the invention.

What is claimed is:

1. A rotation-resisting wire rope comprising a core strand, which comprises a plurality of core strand wires laid in a first lay direction, and a plurality of side strands laid around the core strand in a second lay direction opposite to the first lay direction, each side strand comprising side strand wires laid in the first lay direction and the wire rope having a smaller pitch multiple than a pitch multiple of the side strands:

wherein a ratio of a diameter of the core strand to a diameter of the side strands is from about 1.3 to about 1.8.

2. The rotation-resisting wire of claim 1, wherein a pitch multiple of the side strands is from about 5 to about 8 and a pitch multiple of the wire rope is from about 8 to about 10.

3. The rotation-resisting wire of claim 2, wherein one or both of the core strand and the side strands comprise shaped wires having a flattened surface at an outermost ply.

4. The rotation-resisting wire of claim 2, wherein the core strand and the side strands comprise shaped wires, having a flattened surface, at an outermost ply.

5. The rotation-resisting wire of claim 1, wherein one or both of the core strand and the side strands comprise shaped wires having a flattened surface at an outermost ply.

6. The rotation-resisting wire of claim 1, wherein the core strand and the side strands comprise shaped wires, having a flattened surface, at an outermost ply.

* * * * *